US008749458B2

(12) United States Patent
Kim

(10) Patent No.: US 8,749,458 B2
(45) Date of Patent: Jun. 10, 2014

(54) ORGANIC LIGHT EMITTING DIODE DISPLAY CAPABLE OF ADJUSTING A HIGH POTENTIAL DRIVING VOLTAGE APPLIED TO PIXEL

(75) Inventor: Dowan Kim, Kyungbuk (KR)

(73) Assignee: LG Display Co., Ltd., Seoul (KR)

( * ) Notice: Subject to any disclaimer, the term of this patent is extended or adjusted under 35 U.S.C. 154(b) by 552 days.

(21) Appl. No.: 12/576,484

(22) Filed: Oct. 9, 2009

(65) Prior Publication Data

US 2010/0090932 A1 Apr. 15, 2010

(30) Foreign Application Priority Data

Oct. 10, 2008 (KR) ..... 10-2008-0099802

(51) Int. Cl.
*G09G 3/30* (2006.01)

(52) U.S. Cl.
USPC ..... 345/78; 345/82

(58) Field of Classification Search
CPC ..... G09G 3/30–3/3291
USPC ..... 345/36, 45, 76–83; 315/169.2
See application file for complete search history.

(56) References Cited

U.S. PATENT DOCUMENTS

2006/0055631 A1* 3/2006 Yoshida ..... 345/46
2006/0139254 A1* 6/2006 Hayakawa et al. ..... 345/76
2006/0158393 A1* 7/2006 Fukumoto et al. ..... 345/76
2006/0202631 A1* 9/2006 Hayafuji et al. ..... 315/169.2
2006/0202913 A1* 9/2006 Hayafuji ..... 345/44
2007/0013619 A1* 1/2007 Watanabe et al. ..... 345/76
2007/0194314 A1* 8/2007 Yamazaki et al. ..... 257/66
2008/0136750 A1* 6/2008 Benzarti ..... 345/76

FOREIGN PATENT DOCUMENTS

JP 2006-048011 A 2/2006
JP 2006-251011 A 9/2006

OTHER PUBLICATIONS

KIPO: Office Action for Korean Patent Application No. KR 10-2008-0099802—Issued on Oct. 23, 2013.

* cited by examiner

*Primary Examiner* — Chanh Nguyen
*Assistant Examiner* — Sanghyuk Park
(74) *Attorney, Agent, or Firm* — Morgan, Lewis & Bockius LLP

(57) ABSTRACT

Embodiments of the invention provide an organic light emitting diode (OLED) display capable of preventing a defect of picture quality by instability of an output voltage of a power IC in a low temperature environment. The OLED display comprises: a display panel having an effective display area in which pixels displaying a gray scale are formed and a non-display area in which a pixel monitoring part monitoring a degree of deterioration of the pixels is formed, wherein each of the pixels includes an organic light emitting diode and a driving element; a power IC supplying a driving voltage to the display panel; and a voltage limiting part connected between the pixel monitoring part and the power IC to restrict voltage levels of feedback voltages supplied from the pixel monitoring part.

8 Claims, 6 Drawing Sheets

ORGANIC LIGHT EMITTING DIODE DISPLAY CAPABLE OF ADJUSTING A HIGH POTENTIAL DRIVING VOLTAGE APPLIED TO PIXEL

This application claims the benefit of Korea Patent Application Ser. No. 10-2008-099802 filed on Oct. 10, 2008, which is incorporated herein by reference for all purposes as if fully set forth herein.

BACKGROUND OF THE INVENTION

1. Field of the Invention

Embodiments of the invention relate to an organic light emitting diode (OLED) display capable of adjusting a high potential driving voltage applied to pixels by a monitoring feedback method.

2. Discussion of the Related Art

Various flat panel displays whose weight and size are smaller than cathode ray tubes have been recently developed. Examples of the flat panel displays include a liquid crystal display (LCD), a field emission display (FED), a plasma display panel (PDP), and an electroluminescence device.

Because the PDP has a simple structure and is manufactured through a simple process, the PDP has been considered as a display device having characteristics such as lightness in weight and thin profile and providing the large-sized screen. However, the PDP has disadvantages such as low light emitting efficiency, low luminance, and high power consumption. A thin film transistor (TFT) LCD using a TFT as a switching element is the most widely used flat panel display. However, because the TFT LCD is not a self-emission display, the TFT LCD has a narrow viewing angle and a low response speed. The electroluminescence device is classified into an inorganic light emitting diode display and an organic light emitting diode (OLED) display depending on a material of an emitting layer. In particular, the OLED display has characteristics such as a fast response speed, a high light emitting efficiency, a high luminance, and a wide viewing angle because the OLED display is a self-emission display.

The OLED display, as shown in FIG. 1, includes an organic light emitting diode. The organic light emitting diode includes organic compound layers between an anode electrode and a cathode electrode.

The organic compound layers include a hole injection layer HIL, a hole transport layer HTL, an emitting layer EML, an electron transport layer ETL, and an electron injection layer EIL.

When a driving voltage is applied to the anode electrode and the cathode electrode, holes passing through the hole transport layer HTL and electrons passing through the electron transport layer ETL move to the emitting layer EML and form an exciton. Hence, the emitting layer EML generates visible light.

In the OLED display, pixels each including the above-mentioned organic light emitting diode are arranged in a matrix format, and a brightness of the pixels selected by a scan pulse is controlled depending on a gray level of video data. In the OLED display, the pixel is selected by selectively turning on a TFT used as an active element and remains in a light emitting state by a voltage charged to a storage capacitor.

The OLED display is driven by a digital method or an analog method. The digital method displays a gray scale according to intensity of data voltage or data current applied to pixels. On the other hand, the analog method displays the gray scale according to a supplying time of data voltage or data current applied to pixels in a constant intensity. The OLED display adopting the analog method cannot display a gray scale correctly because electrical characteristics (a threshold value, an electron mobility and so on) of a driving thin film transistor (TFT) are changed in each pixel depending on the intensity of data voltage or data current applied to the pixel. Herein, the driving TFT controls amount of current flowing through the OLED depending to the intensity of data voltage or data current applied to the pixel. However, the OLED display adopting the digital method can display a correct gray scale because the driving TFT is used as only a switching element. In recent, there have been many techniques for driving the OLED display by the digital method.

In general, the OLED display adopting the digital method uses a monitoring feedback method in order to compensate a deterioration of picture quality that is generated due to a characteristic variation of organic material contained in the OLED by a change of external temperature. Referring to FIG. 2, the monitoring feedback method includes steps of forming a pixel monitoring part MP at one side of a display panel in order to predict a deterioration degree of the pixels, sampling a voltage which is feed-backed after applying a constant monitoring current to the pixel monitoring part MP, and adjusting a high potential driving voltage applied to the pixels based on the sampled voltage. The pixel monitoring part MP includes a R (red) monitoring OLED MR to which a first monitoring current Ir is applied, a G (green) monitoring OLED MG to which a second monitoring current Ig is applied, and a B (blue) monitoring OLED MB to which a third monitoring current Ib is applied. If the external temperature is changed, the characteristic of the organic material contained the OLEDs MR, MG and MB is changed. Thus, resistance components of the OLEDs MR, MG and MB are changed. As a result, feedback voltages Vrf, Vgf and Vbf having the changed voltage levels are supplied to a power IC. The power IC adjusts a first high potential driving voltage VOR supplied to the R pixel of the display panel using the R feedback voltage Vrf, adjusts a second high potential driving voltage VOG supplied to the G pixel of the display panel using the G feedback voltage Vgf, and adjusts a third high potential driving voltage VOB supplied to the B pixel of the display panel using the B feedback voltage Vbf. The more resistance components of the OLEDs MR, MG and Mb increase, the more feedback voltages Vrf, Vgf and Vbf increase. In general, if the external temperature is lower, amount of the current flowing through the pixels is decreased, thereby lowering brightness. In order to compensate for the lowered brightness, the high potential driving voltages VOR, VOG and VOB are increased gradually using the feedback voltages Vrf, Vgf and Vbf, respectively, as shown in FIG. 3.

However, in the OLED display adopting the monitoring feedback method, there is a problem demanding an output voltage beyond the maximum output voltage of the power IC as shown in FIG. 3 because the more external temperature is lower, the more output voltages VOR, VOG and VOB are gradually increased in order to prevent the lower of brightness by a change of the external temperature. In the case of demanding an output voltage power beyond the maximum output voltage of the power IC, there is a defect of picture quality such as a flickering phenomenon because the output voltage of the power IC is unstable.

SUMMARY OF THE INVENTION

Embodiments of the invention provide an organic light emitting diode (OLED) display capable of preventing a defect of picture quality due to instability of an output voltage of a power IC in a low temperature environment.

In one aspect, the OLED display comprises, a display panel having an effective display area in which pixels displaying a gray scale are formed and a non-display area in which a pixel monitoring part monitoring a degree of deterioration of the pixels is formed, wherein each of the pixels includes an organic light emitting diode and a driving element; a power IC supplying a driving voltage to the display panel; and a voltage limiting part connected between the pixel monitoring part and the power IC to restrict voltage levels of feedback voltages supplied from the pixel monitoring part.

Moreover, the power IC comprises a current source part supplying constant monitoring currents to the pixel monitoring part; a sampling switch part connected between the current source part and the pixel monitoring part to sample voltages applied to the pixel monitoring part; a driving voltage adjusting part to which the voltage supplied to the pixel monitoring part gets feedback and adjusting levels of high potential driving voltages supplied to the pixels using the feedback voltages; and a detection switch part connected between a node and the driving voltage adjusting part to detect the feedback voltages, wherein the node is between the sampling switch part and the pixel monitoring part, wherein the voltage limiting part restricts levels of the voltages at the node to values lower than maximum output values of the driving voltage adjusting part.

Moreover, the node comprises a first node, a second node and the third node, and wherein the pixel monitoring part 16 comprises a R monitoring OLED MR including an anode electrode connected to the first node and a cathode electrode connected to a ground voltage source, a G monitoring OLED MG including an anode electrode connected to the second node and a cathode electrode connected to the ground voltage source, and a B monitoring OLED MB including an anode electrode connected to the third node and a cathode electrode connected the ground voltage source.

Moreover, the voltage limiting part comprises a first limiting element for restricting level of voltage applied to the first node, a second limiting element restricting level of voltage applied to the second node, and a third limiting element ZB restricting level of voltage applied to the third node.

Moreover, each of the first to third limiting elements comprises a zener diode having a breakdown voltage lower than a maximum output voltage of the driving voltage adjusting part.

Moreover, the cathode electrodes of the first to the third limiting elements are connected to the first to the third nodes, respectively, and the anode electrodes of the first to the third limiting elements are commonly connected to the ground voltage source.

Moreover, a breakdown voltage of the second limiting element is the same as that of the second limiting element, a breakdown voltage of the first limiting element is lower than those of the second and third limiting elements.

Moreover, the detection switch part is turned on during a turn-on period of the sampling switch part in one frame period, and is turned off during a turn-off period of the sampling switch part in the one frame period.

Moreover, the pixel monitoring part is formed on at least one side of the non-display area.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Hereinafter, exemplary embodiments of the invention will be described in detail with reference to the accompanying drawings so that this disclosure is thorough and complete and fully conveys the concept of the invention to those skilled in the art.

Hereinafter, an organic light emitting diode (OLED) display according to an exemplary embodiment of the invention will be described in detail with reference to FIGS. 4 to 8.

Figure 1:
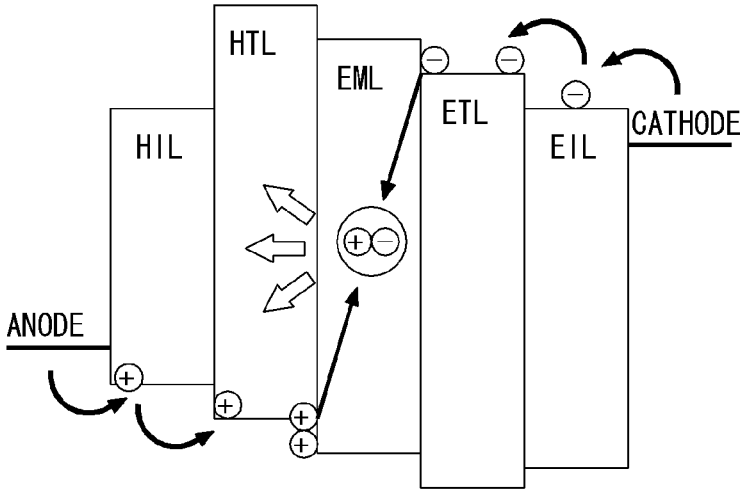
FIG. 1 RELATED ART
FIG. 1 is a diagram illustrating a light emitting principle of a general organic light emitting diode (OLED) display.
Figure 2:
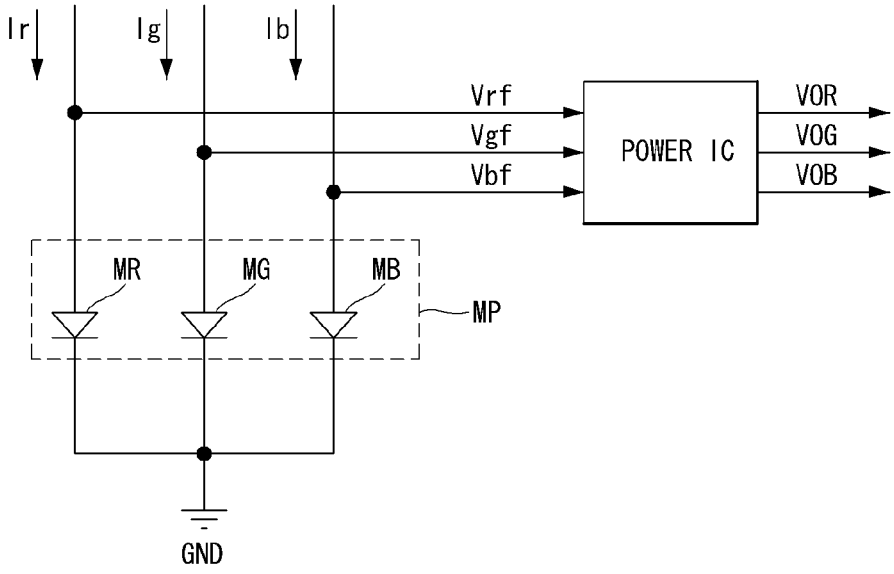
FIG. 2 RELATED ART
FIG. 2 is a diagram illustrating adjustment of a high potential driving voltage in the OLED display adopting a monitoring feedback method.
Figure 3:
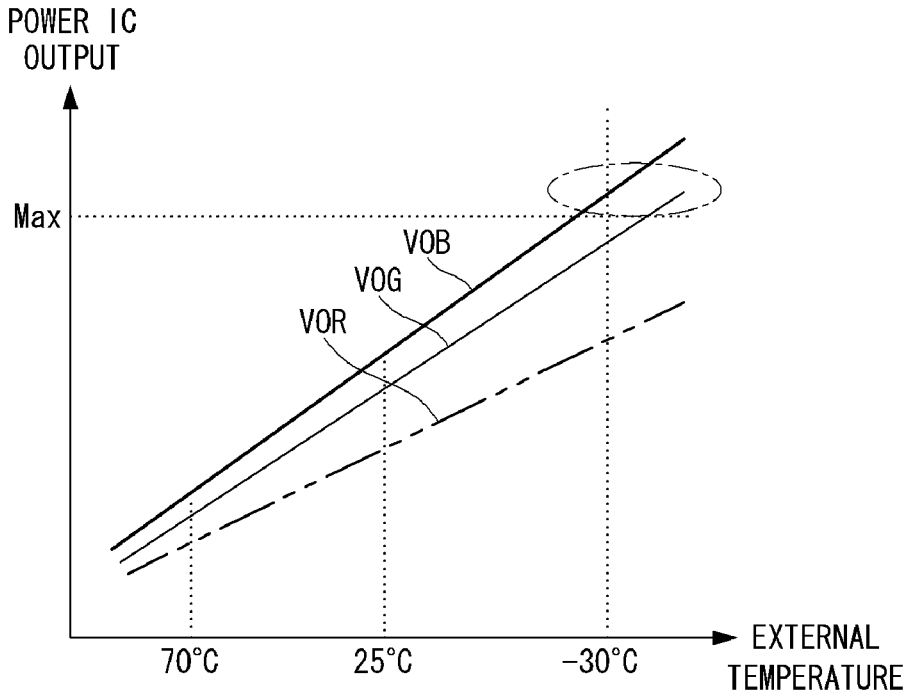
FIG. 3 is a graph illustrating that an adjusted output voltage of a power IC in the OLED display exceeds a maximum output voltage of the power IC.
Figure 4:
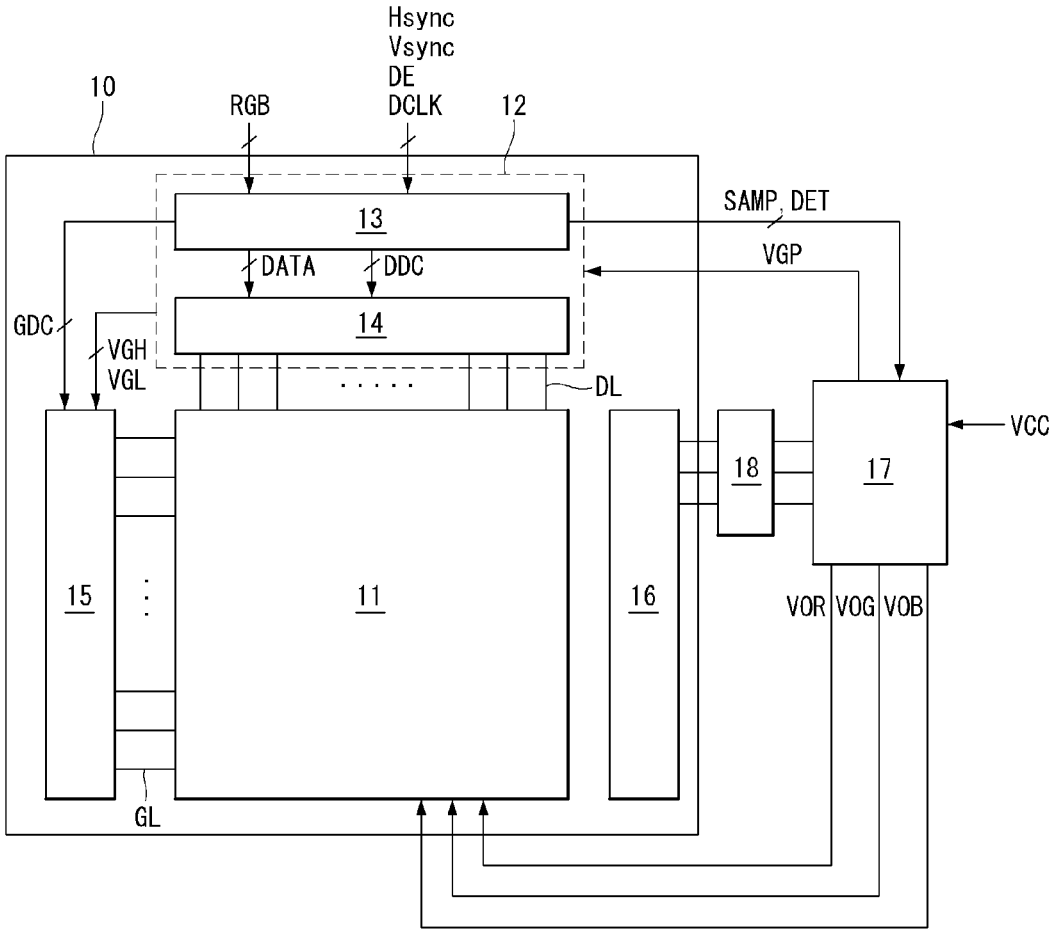
FIG. 4 is a block view of an OLED display according to an exemplary embodiment of the invention.
Figure 5:
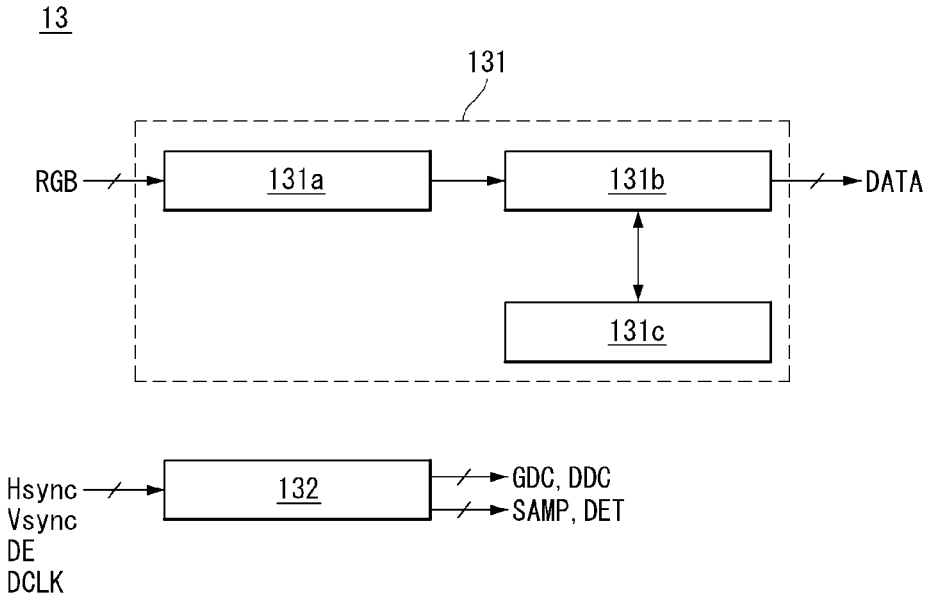
FIG. 5 is a block view illustrating a timing controller shown in FIG. 4.
Figure 6:
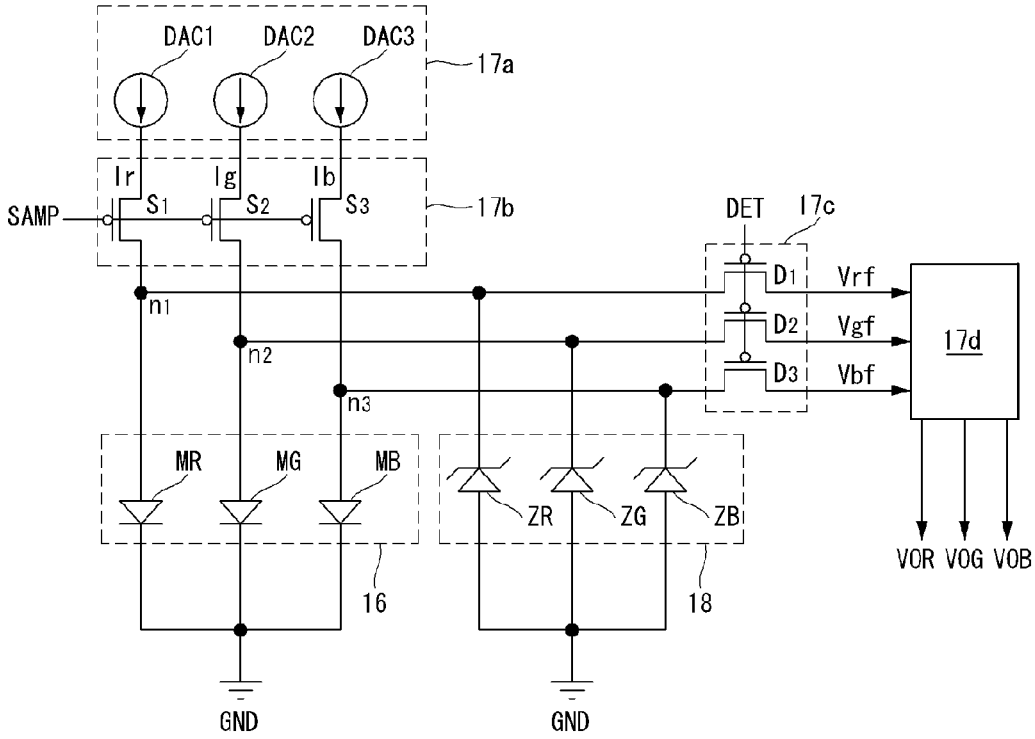
FIG. 6 is a circuit diagram illustrating a connection relation of a pixel monitoring part, a power IC and a voltage limit part.

FIG. 4 is a block view of an OLED display according to an exemplary embodiment of the invention, FIG. 5 is a block view illustrating a timing controller shown in FIG. 4, and FIG. 6 is a circuit diagram illustrating a connection relation of a pixel monitoring part, a power IC and a voltage limit part.

Referring to FIG. 4, the OLED display according to an exemplary embodiment of the invention comprises a display panel 10 having an effective display area 11 in which pixels are formed and a non-display area in which a driver IC 12, a scan driver 15 and a pixel monitoring part 16 are formed, a power IC 17 supplying a driving voltage to the display panel 10, and a voltage limiting part 18 connected between the pixel monitoring part 16 and the power IC 17 to limit levels of feedback voltages feed-backed from the pixel monitoring part 16.

In the effective display area of the display panel 10, a plurality of data lines DL and a plurality of gate lines GL are crossed and pixels are arranged in a matrix type at positions where the data lines DL and the gate lines GL are crossed. The pixels includes a plurality of R pixels displaying red color, a plurality of G pixels displaying green color, and a plurality of B pixels displaying blue color. A first high potential driving voltage VOR is supplied to R pixels, a second high potential driving voltage VOG is supplied to G pixels, and a third high potential driving voltage VOB is supplied to B pixels. The first to third high potential driving voltage VOR, VOG and VOB are changed depending to an ambient temperature. Each of the pixels displays includes an organic light emitting diode (OLED), a driving thin film transistor (TFT), a plurality of switching TFT and a storage capacitor and displays a gray scale according to a digital driving method.

The driver IC 12 includes a timing controller 13, a source driver 14 and a level shifter (not shown) and is mounted on the non-display area of the display panel 10 in chip on glass (COG) type.

The timing controller 13 includes a data converter 131 and a control signal generator 132 as shown in FIG. 5.

The data converter 131 converts an input video data RGB into a digital data type adapted to a digital driving type. To this end, the data converter 131 includes a host memory 131*a*, a data adjusting part 131*b* and a display memory 131*c*. The host memory 131*a* stores the video data RGB supplied from an external by one frame unit. The data adjusting part 131*b* divides the video data RGB corresponding to one frame into j bit planes (herein, j is two or a natural number more than two), and time-divides the video data RGB into k sub-frames (herein, k is two or a natural number more than two) in order to display the video data RGB within one frame. Also the data adjusting part 131*b* stores bit planes to be displayed on a specific sub-frame in the display memory 131*c* by mapping the bit planes to corresponding sub-frames using a time mapping table so that each of the divided bit planes is displayed on one sub-frame or a plurality of sub-frames. Also, the data adjusting part 131*b* supplies the data DATA which is time-divided in the time mapping table type to the source driver 14.

The control signal generator 132 generates a control signal DDC for controlling an operation timing of the source driver 14, a control signal GDC for controlling an operation timing of the scan driver 15, and control signals SAMP and DET for controlling sampling and detecting operations of the power IC 17 based on timing signals including a vertical synchronization signal Vsync, a horizontal synchronization signal Hsync, a dot clock signal DCLK, a data enable signal DE and so on. The control signal DDC for controlling the operation timing of the source driver 14 includes a source sampling clock signal instructing a latch operation of data in the source driver 14, a source enable signal instructing an output of the source driver 14 and so on depending on rising edge or falling edge. The control signal GDC for controlling the operation timing of the scan driver 15 includes a gate start pulse instructing a start horizontal line from which a scan starts, a gate shift clock signal which is input to the shift register in the scan driver 15 and has a pulse width corresponding to ON period of TFT as a timing control signal for sequentially shifting the gate start pulse, a gate enable signal instructing an output of the scan driver 15 and so on. The sampling control signal SAMP for controlling a sampling operation of the power IC 17 supplies a constant monitoring current to the pixel monitoring part 16, and instructs a time for sampling a voltage applied to the pixel monitoring part 16. The detection control signal DET for controlling a detection operation of the power IC 17 instructs a time for receiving the sampled voltage.

The source driver 14 converts the input data DATA into analog data voltage and supplies it to the data lines DL in response to the control signal DDC from the timing controller 13.

The level shifter refers to a driving voltage VGP from the power IC 17, generates voltage levels adapted to the operation of the TFTs, that is, a scan high voltage VGH and a scan low voltage VGL, and supplies them to the scan driver 15.

The scan driver 15 comprises a shift register array formed on the non-display area of the display panel 10 in a gate in panel (GIP) type by using the manufacturing process of the TFTs in the pixel. The scan driver 15 sequentially shifts the scan high voltage VGH and the scan low voltage VGL in response to the control signal GDC from the timing controller 13 and generates scan pulses. The scan driver 15 also selects a horizontal line to which a data is written by sequentially supplying the scan pulse to the gate lines.

The pixel monitoring part 16 is formed on the non-display area of the display panel 10. The pixel monitoring part 16 includes a R monitoring OLED MR to which the first monitoring current Ir is supplied, a G monitoring OLED MG to which the second monitoring current Ig is supplied, and a B monitoring OLED MB to which the third monitoring current Ib is supplied, as shown in FIG. 6. The R monitoring OLED MR has an anode electrode connected to a first node n1 and a cathode electrode connected to a ground voltage source GND. The G monitoring OLED MG has an anode electrode connected to a second node n2 and a cathode electrode connected to the ground voltage source GND. The B monitoring OLED MB has an anode electrode connected to a third node n3 and a cathode electrode connected to the ground voltage source GND. The pixel monitoring part 16 may be formed on both sides of the non-display area of the display panel 10. For example, the R monitoring OLED MR and the G pixel monitoring MG may be formed on left side of the non-display area of the display panel 10, and B pixel monitoring MB is formed on right side of the non-display area of the display panel 10. On the other hand, the pixel monitoring part 16 may be formed on only one side of the non-display area of the display panel 10.

The power IC 17 generates a driving voltage VGP for driving the level shifter, and the high potential driving voltages VOR, VOG and VOB for driving the pixels using the input voltage source VCC. Also, the power IC 17 adjusts levels of the high potential driving voltages VOR, VOG and VOB using the feedback voltages Vrf, Vfg and Vbf from the pixel monitoring part 16.

To this end, the power IC 17 includes a current source part 17*a* for supplying constant monitoring currents Ir, Ig and Ib, a sampling switching part 17*b* for switching a current path between the current source part 17*a* and the pixel monitoring part 16, a driving voltage for adjusting part 17*d* adjusting levels of the high potential driving voltages VOR, VOG and VOB, and a detection switch part 17*c* for switching a current path between the nodes n1, n2 and n3 and the driving voltage adjusting part 17*d* as shown in FIG. 6.

The current source part 17*a* includes a first current source DAC1 for generating the first monitoring current Ir, a second current source DAC2 for generating the second monitoring current Ig, and a third current source DAC3 for generating the third monitoring current Ib. Herein, if the first to third monitoring currents Ir, Ig and Ib have a same value, the first to third current sources DAC1 to DAC3 may be replaced with one current source.

The sampling switch part 17*b* includes a first sampling switch S1 for switching a current path between the first current source DAC1 and the first node n1 depending to the sampling control signal SAMP, a second sampling switch S2 for switching a current path between the second current source DAC2 and the second node n2 depending to the sampling control signal SAMP, and a third sampling switch S3 for switching a current path between the firs current source DAC3 and the third node n3 depending to the sampling control signal SAMP. Each of the first to third sampling switches 51, S2 and S3 comprises a P type MOS transistor.

The detection switch part 17*c* includes a first detection switch D1 for switching a current path between the first node n1 and the driving voltage adjusting part 17*d* depending to the detection control signal DET, a second detection switch D2 for switching a current path between the second node n2 and the driving voltage adjusting part 17*d* depending to the detection control signal DET, and a third detection switch D3 for switching a current path between the third node n3 and the driving voltage adjusting part 17*d* depending to the detection control signal DET. Each of the first to third detection switches D1, D2 and D3 comprises a P type MOS transistor.

The driving voltage adjusting part 17*d* adjusts levels of the high potential driving voltages VOR, VOG and VOB supplied to the pixels of the display panel 10 using the feedback voltages Vrf, Vgf and Vbf.

The voltage limiting part 18 includes a first limiting element ZR connected to the R monitoring OLED MR in parallel, a second limiting element ZG connected to the G monitoring OLED MG in parallel, and a third limiting element ZB connected to the B monitoring OLED MB in parallel. Each of the first to third limiting elements ZR, ZG and ZB comprises a zener diode having a breakdown voltage lower than the maximum output voltage of the power IC 17. The first limiting element ZR includes a cathode electrode connected to the first node n1 and an anode electrode connected to the ground voltage source GND. The first limiting element ZR forms a reverse current path flowing from the cathode electrode to the anode electrode when a voltage larger than the breakdown voltage thereof is applied to the first node n1. The second limiting element ZG includes a cathode electrode connected to the second node n2 and an anode electrode connected to the ground voltage source GND. The second limiting element ZG forms a reverse current path flowing from the cathode electrode to the anode electrode when a voltage larger than the breakdown voltage thereof is applied to the second node n2. The third limiting element ZB includes a cathode electrode connected to the third node n3 and an anode electrode connected to the ground voltage source GND. The third limiting element ZB forms a reverse current path flowing from the cathode electrode to the anode electrode when a voltage larger than the breakdown voltage thereof is applied to the third node n3. Each of the first to third limiting elements ZR, ZG and ZB restricts the potential levels at first to third nodes n1, n2 and n3 to the levels of the breakdown voltage thereof. Accordingly, it is possible to resolve the technical problem that the level of the feedback voltages Vrf, Vgf and Vbf are increased gradually under a low temperature environment. On the other hand, the first to third limiting elements ZR, ZG and ZB may have another breakdown voltage value so as to prevent a color coordinates of a display video from being out of a reference range. For example, the breakdown voltage of the first limiting element ZR may be lower than those of the second and third limiting elements ZG and ZB. From experiments, the inventor had known that the color coordinate of the display video is very excellent when the breakdown voltage of the first limiting element ZR is 8.2 Volts, and the breakdown voltage of the second and third limiting elements ZG and ZB is 9.1 Volts in case that the matrix output voltage of the power IC 17 is set to 12 Volts.

Figure 7:
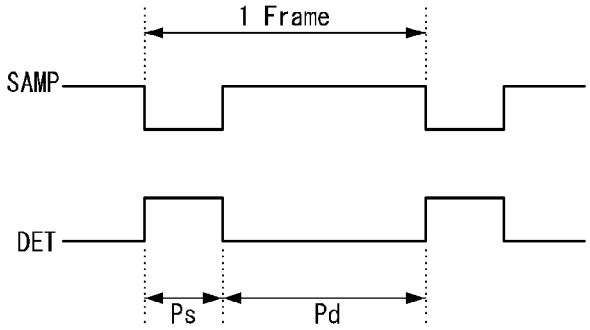
FIG. 7 is a waveform diagram illustrating a sampling control signal and a detection control signal.

FIG. 7 shows the sampling control signal SAMP and the detection control signal DET.

Hereinafter, the operations of sampling and detecting the feedback voltages Vrf, Vgf and Vbf will be described in detail with reference to the FIG. 7.

During a sampling period Ps, the sampling control signal SAMP is generated as a low logic level and makes the sampling switches S1 to S3 turned on. Also, the detection control signal DET is generated as a high logic level and makes the detection switches D1 to D3 turned off. Accordingly, the first to third monitoring currents Ir, Ig and Ib flow through the monitoring OLEDs MR, MG and MB connected between the first to the third current sources DAC1, DAC2 and DAC3 and the ground voltage source GND. At this time, the more the external temperature lower, the more potential level at the nodes n1, n2 and n3 increase, because the resistance components of the OLEDs MR, MG and MB are increased when an external temperature is lower. According to the embodiment of the invention, although the external temperature is lower, the potential levels at the nodes n1 to n3 are restricted to the levels of the breakdown voltages of the first to third limiting elements ZR, ZG and ZB by the first to third limiting elements ZR, ZG and ZB.

During a detection period Pd, the sampling control signal SAMP is reversed to the high logic level to make the sampling switches S1 to S3 turned off, the detection control signal DET is reversed to the low logic level to make the detection switches D1 to D3 turned on. Accordingly, the voltages of the nodes n1 to n3 are supplied to the power IC 17 as the feedback voltages Vrf, Vgf and Vbf. Herein, the maximum voltages at the nodes n1 to n3 are restricted to the levels of the breakdown voltages of the first to third limiting elements ZR, ZG and ZB, respectively.

Above-mentioned sampling and detection operations are performed every frame. However, to simplify the driving method, the sampling and detection operations are performed at once by a few frames.

Figure 8:
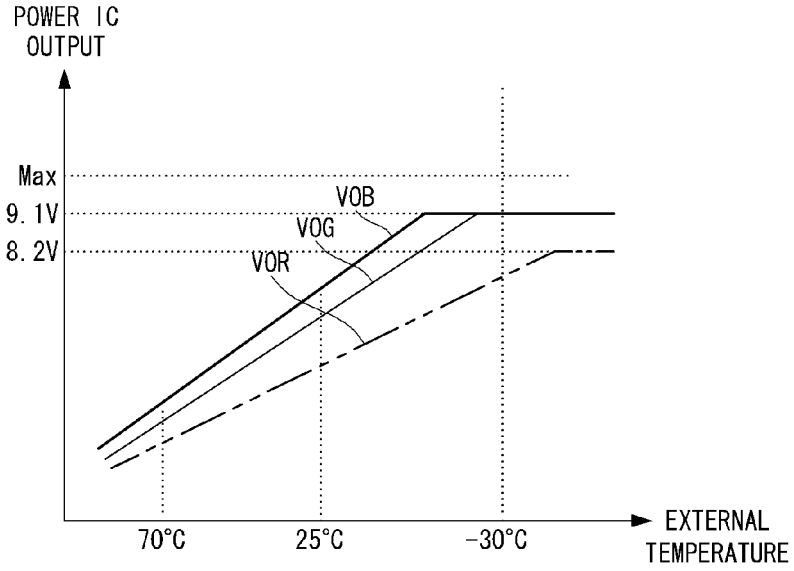
FIG. 8 is a graph illustrating that an adjusted output voltage of the power IC in the OLED display is limited in a range of the maximum output voltage of the power IC by restricting upper limits of feedback voltages.

FIG. 8 illustrates that the maximum adjusting values of the high potential driving voltages VOR, VOG and VOB are restricted to the maximum output voltage value Max of the power IC 17 by the restriction of the feedback voltages Vrf, Vgf and Vbf. In FIG. 8, X axis indicates the output voltage of the power IC and Y axis indicates the external temperature.

Referring to FIG. 8, the high potential driving voltages VOR, VOG and VOB are adjusted so that the more external temperature is lower, the more high potential driving voltages VOR, VOG and VOB are increased. However, the high potential driving voltages VOR, VOG and VOB do not exceed the maximum output voltage of the power IC 17. For example, in case that the breakdown voltage of the first limiting element Zr is 8.2 volts, the maximum value of the first high potential driving voltage VOR is adjusted to 8.2 volts, and the maximum values of the second and the third high potential driving voltages VOG and VOB are adjusted to 9.1 volts because the power IC 17 adjusts the high potential driving voltages VOR, VOG and VOB based on the feedback voltages Vrf, Vgf and Vbf so that the maximum voltages are set to the breakdown voltages of the limiting elements ZR, ZG and ZB.

As above-mentioned, the OLED display according to the embodiment of the invention can prevent a defect of picture quality due to instability of the output voltage of the power IC in a low temperature environment because it is possible to adjust the high potential driving voltages within a range of the maximum output voltage of the power IC by restricting the maximum value of the feedback voltages using the limiting elements which are connected with the pixel monitoring part in parallel when the high potential driving voltages supplied to the pixels are adjusted based on the voltage values of the feedback voltages supplied from the pixel monitoring part.

It will be apparent to those skilled in the art that various modifications and variations can be made in the embodiments of the invention without departing from the spirit or scope of the invention. For example, the embodiment of the invention is described with reference to the OLED display driven by the digital method, but may be applied to the OLED display driven by the analog method. Thus, it is intended that embodiments of the invention cover the modifications and variations of this invention provided they come within the scope of the appended claims and their equivalents.

What is claimed is:

1. An OLED display comprises:

a display panel comprising an effective display area in which pixels displaying a gray scale are formed and a non-display area in which a pixel monitoring part monitoring a degree of deterioration of the pixels is formed, each of the pixels comprising an organic light emitting diode and a driving element;

a control signal generator configured to generate a sampling control signal and a detection control signal;

a power IC (integrated circuit) configured to supply a driving voltage to the display panel; and a voltage limiting part connected between the pixel monitoring part and the power IC and configured to restrict voltage levels of feedback voltages supplied from the pixel monitoring part, wherein the power IC comprises:

a current source part configured to supply constant monitoring currents to the pixel monitoring part;

a sampling switch part connected between the current source part and the pixel monitoring part and configured to supply the constant monitoring currents to the pixel monitoring part according to the sampling control signal;

a driving voltage adjusting part to which the voltage supplied to the pixel monitoring part gets feedback and configured to adjust levels of high potential driving voltages supplied to the pixels using the feedback voltages; and a detection switch part connected between a node and the driving voltage adjusting part configured to detect the feedback voltages according to the detection control signal, the node being between the sampling switch part and the pixel monitoring part, wherein the sampling switch part is turned on by the sampling control signal during a sampling period of one frame period, and the detection switch part is turned off by the detection control signal during the sampling period, the one frame period including the sampling period and a detection period, and wherein the sampling switch part is turned off by the sampling control signal during the detection period, and the detection switch part is turned on during the detection period to supply the driving voltage adjusting part with the feedback voltages from the pixel monitoring part restricted by the voltage limiting part.

2. The OLED display of claim 1, wherein the voltage limiting part is further configured to restrict levels of the voltages at the node to values lower than maximum output values of the driving voltage adjusting part.

3. The OLED display of claim 2, wherein:

the node comprises a first node, a second node, and a third node; and the pixel monitoring part comprises:

a red monitoring OLED comprising an anode electrode connected to the first node and a cathode electrode connected to a ground voltage source, a green monitoring OLED comprising an anode electrode connected to the second node and a cathode electrode connected to the ground voltage source; and a blue monitoring OLED comprising an anode electrode connected to the third node and a cathode electrode connected the ground voltage source.

4. The OLED display of claim 2, wherein the pixel monitoring part is formed on at least one side of the non-display area.

5. The OLED display of claim 3, wherein the voltage limiting part comprises:

a first limiting element configured for restricting a level of voltage applied to the first node;

a second limiting element configured for restricting a level of voltage applied to the second node; and a third limiting element configured for restricting a level of voltage applied to the third node.

6. The OLED display of claim 5, wherein each of the first to third limiting elements comprises a zener diode comprising a breakdown voltage lower than a maximum output voltage of the driving voltage adjusting part.

7. The OLED display of claim 6, wherein:

the cathode electrodes of the first to the third limiting elements are connected to the first to the third nodes, respectively; and the anode electrodes of the first to the third limiting elements are commonly connected to the ground voltage source.

8. The OLED display of claim 6, wherein:

a breakdown voltage of the second limiting element is the same as that of the third limiting element; and a breakdown voltage of the first limiting element is lower than those of the second and third limiting elements.

* * * * *